United States Patent [19]

Jones

[11] Patent Number: 4,803,939

[45] Date of Patent: Feb. 14, 1989

[54] SLOT-FORMING FOIL CONSTRUCTION FOR SAILING YACHTS

[75] Inventor: Theodore A. Jones, New Hampton, N.H.

[73] Assignee: Christopher Gardner, Greenwich, Conn. ; a part interest

[21] Appl. No.: 90,677

[22] Filed: Aug. 28, 1987

[51] Int. Cl.[4] ..... B63H 9/04

[52] U.S. Cl. ..... 114/39.1; 114/102

[58] Field of Search ..... 114/39.1, 39.2, 102, 114/103; 244/210

[56] References Cited

U.S. PATENT DOCUMENTS

| | | | |
|---|---|---|---|
| 3,246,335 | 4/1966 | Alvarez-Calderon | 244/210 |
| 4,402,277 | 9/1983 | Wainwright | 114/103 |
| 4,437,426 | 3/1984 | Latham | 114/103 |
| 4,702,186 | 10/1987 | Tiede | 114/39 |

FOREIGN PATENT DOCUMENTS

| | | | |
|---|---|---|---|
| 1178649 | 9/1985 | U.S.S.R. | 114/102 |
| 2110622 | 6/1983 | United Kingdom | 114/102 |
| 86/06698 | 11/1986 | World Int. Prop. O. | 114/102 |

*Primary Examiner*—Sherman D. Basinger
*Assistant Examiner*—Stephen P. Avila
*Attorney, Agent, or Firm*—Schweitzer & Cornman

[57] ABSTRACT

A slot-forming foil enhances the performance of sailing yachts without jibs. A two-part foil is provided, including a forward foil section and an aft section pivoted to the forward section and having alternate, toggled working positions. In either working position, the two-part assembly forms a foil of principally convex airfoil contours on the leeward side and principally concave airfoil contours on the windward side. The entire assembly forms a slot in conjunction with the luff of a working sail of the vessel, improving performance and tacking angle.

11 Claims, 4 Drawing Sheets

SLOT-FORMING FOIL CONSTRUCTION FOR SAILING YACHTS

BACKGROUND AND SUMMARY OF THE INVENTION

Fore and aft rigged sail boats quite typically employ a multiple sail configuration for improving efficiency and performance when going to windward. A typical Bermuda-rigged sloop, for example, employs a main sail and jib, with the two sails being trimmed in concert in a manner that each enhances the performance of the other.

Notwithstanding the superior windward performance of the Bermuda rig, for example, many sailing vessels, such as cat-rigged sloops, ketches and schooners, utilize mast-mounted sails without jibs. Such vessels, at a sacrifice to windward ability, have advantages of convenience and in many cases have superior off-wind performance.

It is generally believed that the superior windward performance of a Bermuda rig, for example, is derived from the slot-forming effect of the jib, in association with the main sail. It is accordingly a feature of the invention to provide a novel and improved slot-forming foil device, for use on cat-rigged and similar vessels employing no jib, for the purpose of providing a slot effect, similar to that provided by a jib, but without the cost, structural loading, and handling complications of a conventional jib. It is known, in for example, the Latham U.S. Pat. No. 4,437,426 to provide a slat-like device immediately in advance of a single sail, in order to provide a slot effect and thereby to enhance the performance of the single sail. The slat device of the Latham patent is a freely pivoted, self-tending element, which is adequately suited for a small, trailerable or car top carryable craft, but would have limited practical usefulness in a larger cruising-size yacht intended to be left unattended at a dock or mooring for extended periods of time.

In accordance with the present invention, a novel and improved slot-forming foil mechanism is provided, suitable for installation on a cat-rigged or similar type of cruising or racing yacht and which is suitable to be left unattended on such yacht during extended periods of mooring or dockage. In accordance with another important aspect of the invention, a novel and improved slot-forming foil device is provided, which is of a two-part, asymmetrical construction, so as to provide an efficient aerodynamic shape in operation but which is aerodynamically inert when left unattended. More particularly the new slot-forming foil comprises a leading portion which is of symmetrical configuration, having a relatively bulbous leading edge portion and symmetrical, concavely contoured aft portions, terminating along a relatively fine trailing edge. Articulated along the full length of the trailing edge is an aft foil section, which is of symmetrical configuration, comprising a large radius arcuate back surface, and symmetrical, concavely contoured front surface portions joining along the center line of the section and defining its leading edge. The relatively sharp trailing edge of the forward section is joined to the leading edge of the after section along an axis of articulation. The flap-like aft section of the foil is provided with over-center means arranged to maintain it normally in one or the other of two operating positions. In either of its operating positions, it configures the articulated assembly to have an asymmetrical cross section comprising, on the "leeward" side a smooth, convex airfoil-like configuration and, on the "windward" side, a concave, slot-forming configuration. When tacking the vessel from one tack to the other, the flap-like foil section is pivoted to its opposite working position, so that the asymmetry of the slot-forming foil is reversed.

Significant improvements in windward performance of cat-rigged sailing vessels can be achieved with the new structure.

For a more complete understanding of the above and other features and advantages of the above invention, reference should be made to the following detailed description of a preferred embodiment and to the accompanying drawings.

DESCRIPTION OF PREFERRED EMBODIMENTS OF THE INVENTION

Figure 1:
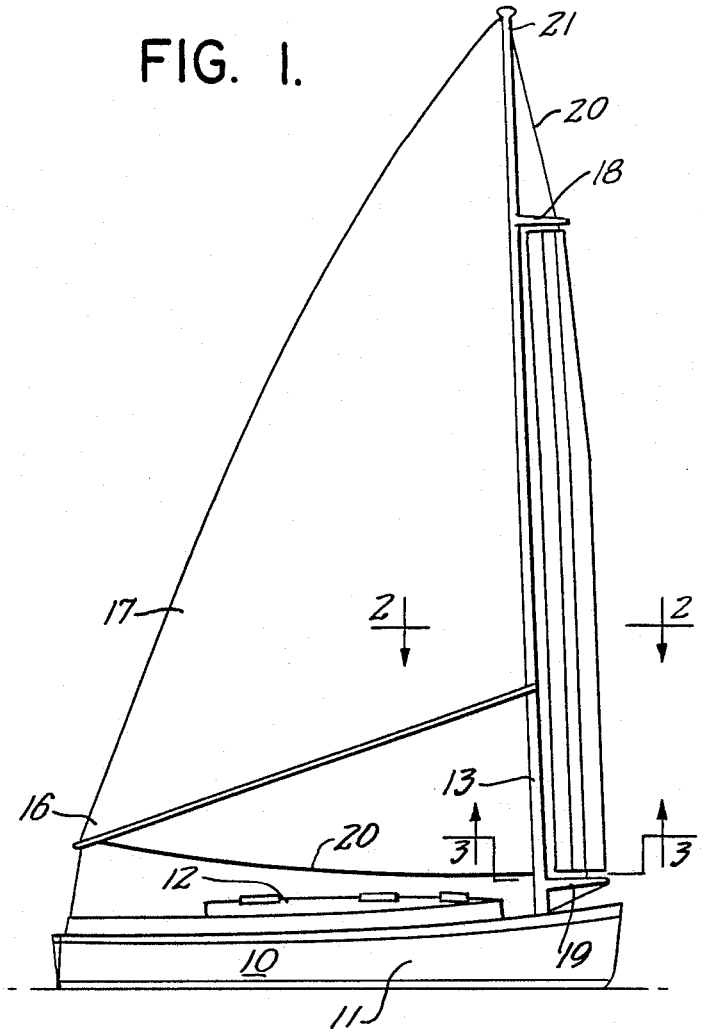
FIG. 1 is a side elevational view of a cat-rigged sailing yacht of typical construction utilizing the special slot-forming foil mechanism of the invention.

Referring now to the drawings, and initially to FIGS. 1–4 thereof, the reference numeral 10 designates a typical sailing yacht of cat-rigged construction, including hull 11, cabin trunk 12 and mast 13. In the illustrated arrangement, the mast 13 is unstayed, but the invention by no means precludes the use of stayed rigs.

Figure 2:
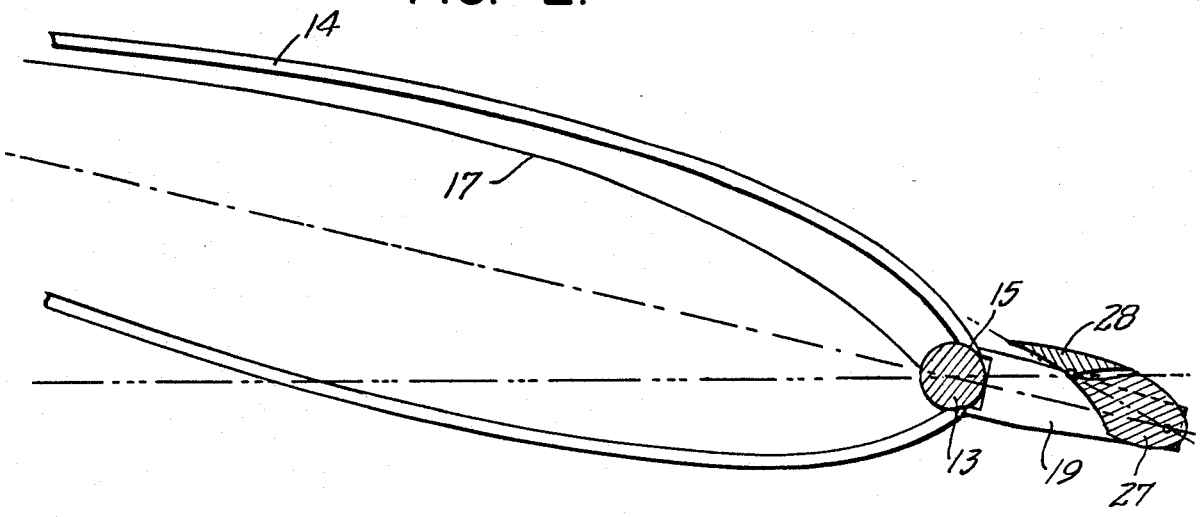
FIG. 2 is an enlarged, fragmentary cross sectional view as taken generally on line 2—2 of FIG. 1.
Figure 3:
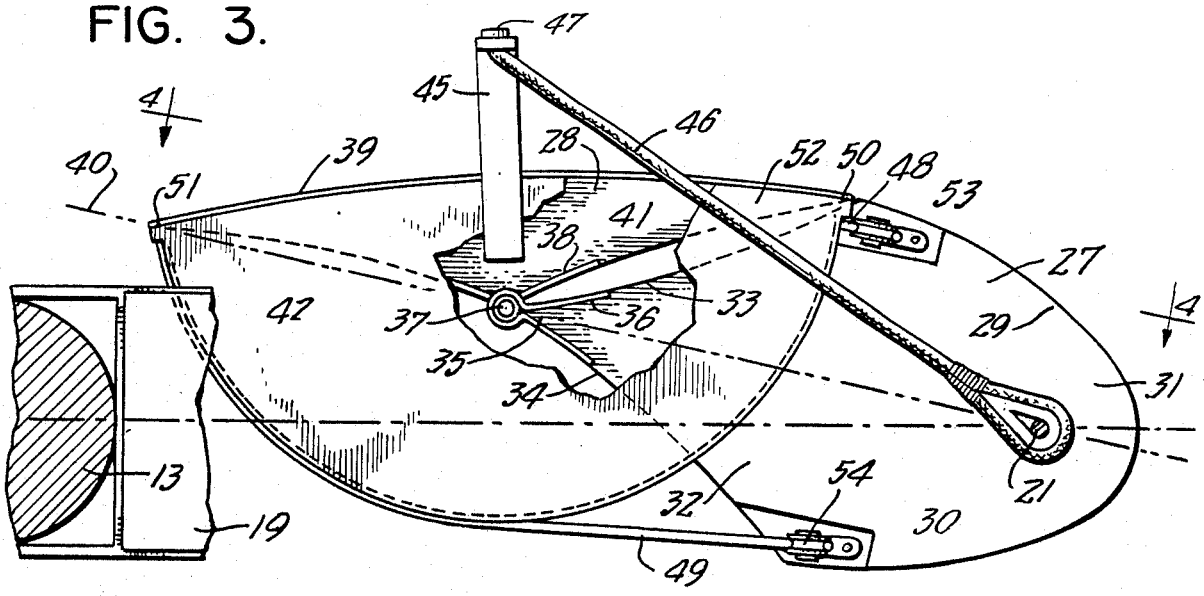
FIG. 3 is an enlarged, fragmentary cross sectional view as taken generally on line 3—3 of FIG. 1.
Figure 4:
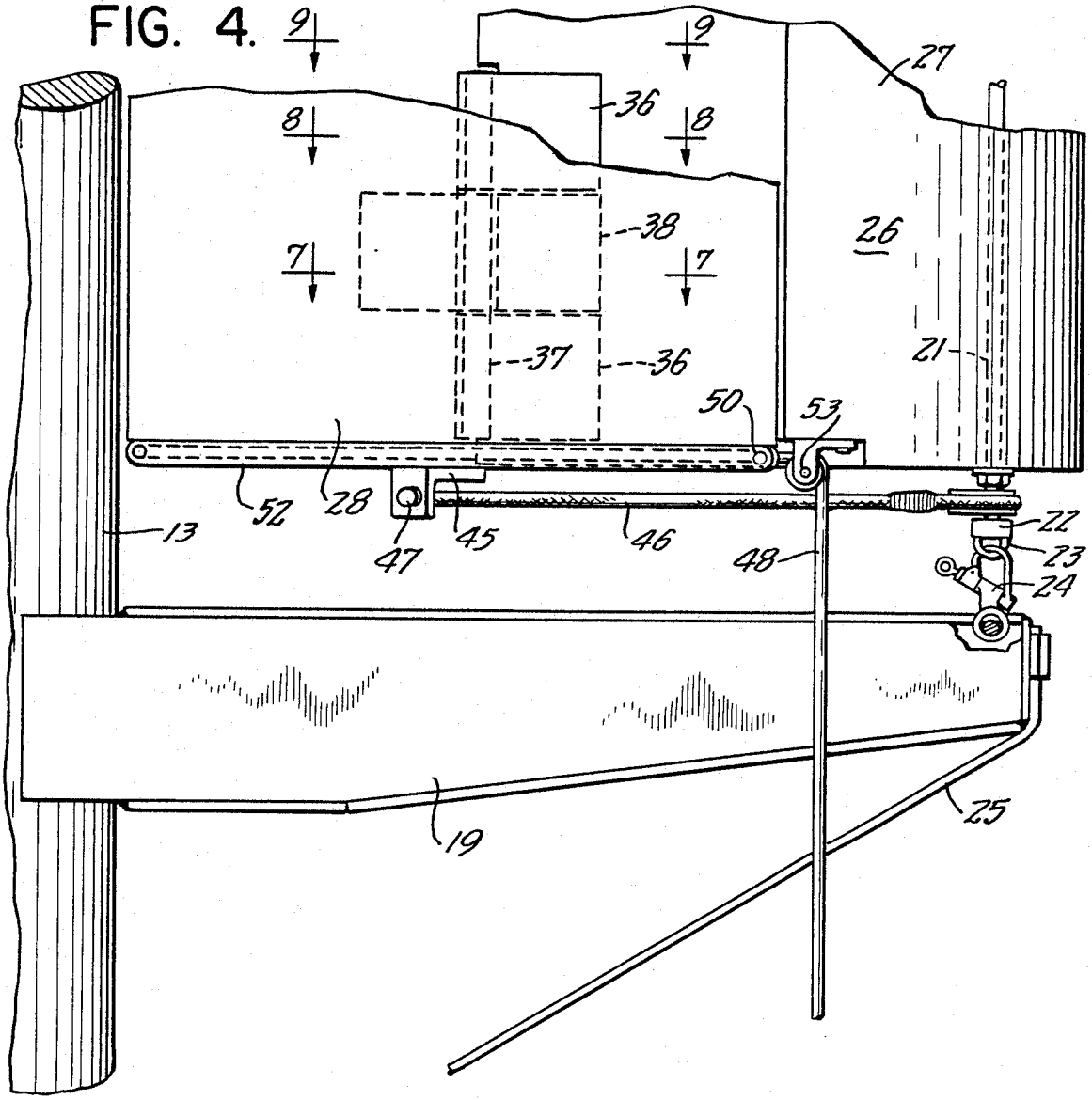
FIG. 4 is a fragmentary elevational view as taken generally on line 4—4 of FIG. 3.

In the yacht illustrated in FIGS. 1 and 2, a wishbone boom 14, secured at its leading edge 15 to the mast 13, is employed to secure the clew 16 of the main working sail 17 to provide foot tensioning for shaping of the sail into an airfoil-like shape, as shown in FIG. 2. Where a wishbone boom 14 is employed, the mast 13 rotates within the hull 11 for different settings of the sail. This is a preferred arrangement for utilization of the invention, although it works quite satisfactory with a more conventional pivoted boom arrangement, wherein the mast is fixed against rotation relative to the hull 11 and a boom is pivoted to the mast.

Fixed to the mast 13 are upper and lower foil mounting brackets 18, 19. These brackets extend forward of the mast a limited distance, for example, 12–14 inches. The lower bracket 19 may be positioned at a level just slightly below the foot 20 of the main sail 17. Typically, the upper bracket 18 is located a few feet below the top of the mast 13, in order to facilitate bracing etc.

A stainless steel cable 21, which typically may be of about 3/16th-¼ inch in diameter is anchored at its lower end to the lower bracket 19 and extends upward under tension through the upper bracket 18 and to an attachment at the top of the mast. Typically, the attachment may be a haylard. The lower extremity of the cable is attached to a terminal fitting 22 provided with a closed bail 23. In the illustrated arrangement of the invention, the bail 23 is engaged by a snap shackle 24 bolted to the lower bracket 19. A tension brace 25 extends from the outer end of the bracket 19 to the base of the mast to help carry the tension load of the cable 21, as will be understood.

Pivotally mounted on the cable 21 is a slot-forming foil assembly 26, comprising a forward foil section 27 and an aft foil section 28. Typically, the foil sections 27, 28 are formed of a lightweight, strong material, such as foamed polystyrene.

The foil assembly 26 extends in height substantially the entire distance between the upper and lower mounting brackets 18, 19. The forward foil section 27 is provided with a vertical passage throughout its entire length receiving the cable 21, which forms a freely functioning pivot support for the foil assembly 26. If desired, the vertical passage through the foil section 27 may be reinforced, as by a lining of plastic pipe or the like (not shown).

To advantage, the forward foil section 27 has, for the first portion (e.g., 40% or so) of its length, a shape similar in sectional shape to the first 7.5% of cord length of NACA Basic Thickness Form $64_2$A015. This provides a relatively a blunt, symmetrical section comprising externally convex surface portions 29, 30 (see FIG. 3). The forward portion of the foil section, identified for convenience by the reference numeral 31, is joined directly with an aft portion 32, formed by externally concave surfaces 33, 34 which converge symmetrically to a relatively sharp trailing edge 35.

Mounted along the trailing edge 35 are hinge brackets 36 which are joined by hinge pins 37 to hinge brackets 38 carried by the forward extremities of the aft foil section 28, sometimes referred to herein as a flap section. The flap section is articulated to the forward section 27 along the axis of the hinge pins 37, located periodically along the length of the assembly. The "outer" or back surface 39 of the flap section is comprised of a long radius convex arc. The cord depth of the arc is such that, when the flap is rotated to one of two limit positions (see FIG. 3) the convex outer surface 39 substantially forms a smooth continuation of one or the other of the convex surfaces 29, 30 of the forward foil section and continues substantially until it intersects the symmetrical axis 40 of the forward foil section 27. In the configuration shown in FIG. 3, the respective surfaces 29, 39 of the articulated flap section form in effect a continuous convex airfoil shape from the front extremity to the aft extremity of the foil assembly.

On the opposite side of the flap forming section 28 there are provided symmetrical, concave surfaces, 41, 42 which are of complementary contour to the concave surfaces 33, 34 of the forward foil section 27. When the flap section 28 is in one of its working positions, one of the concave surfaces of the flap (the surface 42 in FIG. 3) forms an effective continuation of the exposed concave surface (34 in FIG. 3) of the forward flap section. Accordingly, the assembled foil sections 27, 28 constitute an asymmetric slot-forming airfoil section, with one side being smoothly convexly contoured from front to back and with the other side forming a smooth concave contour, commencing from a short distance back from the leading edge and extending to the trailing edge. In accordance with the invention, the asymmetry of the foil may be reversed by pivoting the flap section 28 from one limit position to another, through an angle of approximately 160°.

In the form of the invention shown in FIGS. 1–4, there is shown a simple toggle arrangement for holding the flap-forming section 28 in one or the other of its two working positions. The toggle arrangement includes a lever arm 45 (FIG. 3) which is fixed to the bottom of the flap-forming section 28. An elastic member 46 is anchored at one end 47 to the outer end of the lever arm 45 and is secured at its forward end to the foil mounting calbe 21. The length of the elastic member 46 is such, in relation to the geometry of the foil sections 27, 28, that the elastic member is under tension under any conditions. However, when the flap-forming 28 is pivoted away from one working position toward the other, the elastic member 46 has to extend lengthwise as the lever arm 45 approaches a dead center position, aligned with the axis of symmetry 40 of the forward foil section 27. Thus, the elastic member resists pivoting movement of the flap-forming section 28 up to the point of dead center. Once the section passes beyond dead center, the elastic member urges the section 28 into its alternate working position.

In the illustrated arrangement, positioning of the flap-forming section 28 is controlled by a pair of tacking lines 48, 49, which are anchored at the opposite end extremities 50, 51 respectively of a semicircular plate 52. Fixed to the bottom of the flap-forming section 28. The respective tacking lines 48, 49 are led forward and about lead blocks 53, 54 mounted on the bottom of the forward foil section 27. The tacking lines may be led downward to the deck of the vessel, or directly back to the cockpit, or wherever is convenient to the particular configuration of the vessel. When the vessel is tacked from one tack to the other, the slot-forming foil assembly 26 will automatically swing through and assume a position on the opposite tack. However, in the arrangement of the device shown in FIGS. 1–4, it is necessary to flip the flap-forming section 28 from one position to the other, so that the foil assumes its proper asymmetrical configuration on the new tack. This is accomplished by simply pulling on the appropriate tacking line 48 or 49. In the illustration of the drawings, the position of the foil section 29 would be reversed from that shown in FIG. 3 by pulling on the tacking line 49. Once the foil is swung by the tacking line to a position beyond dead center, the elastic member 46 serves to carry the foil section through the rest of its pivoting movement into its alternate working position for the opposite tack.

Figure 5:
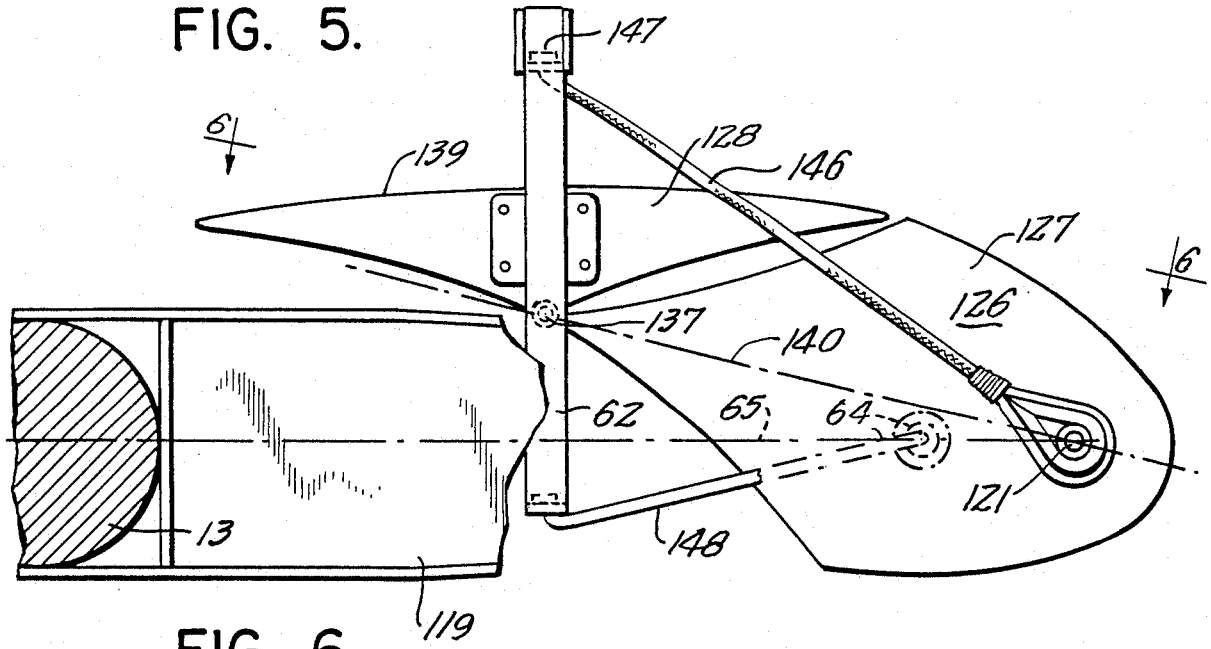
FIGS. 5 and 6 are views, similar to FIGS. 3, 4 respectively, showing a modified form of operating mechanism for a new slot-forming foil mechanism.
Figure 6:
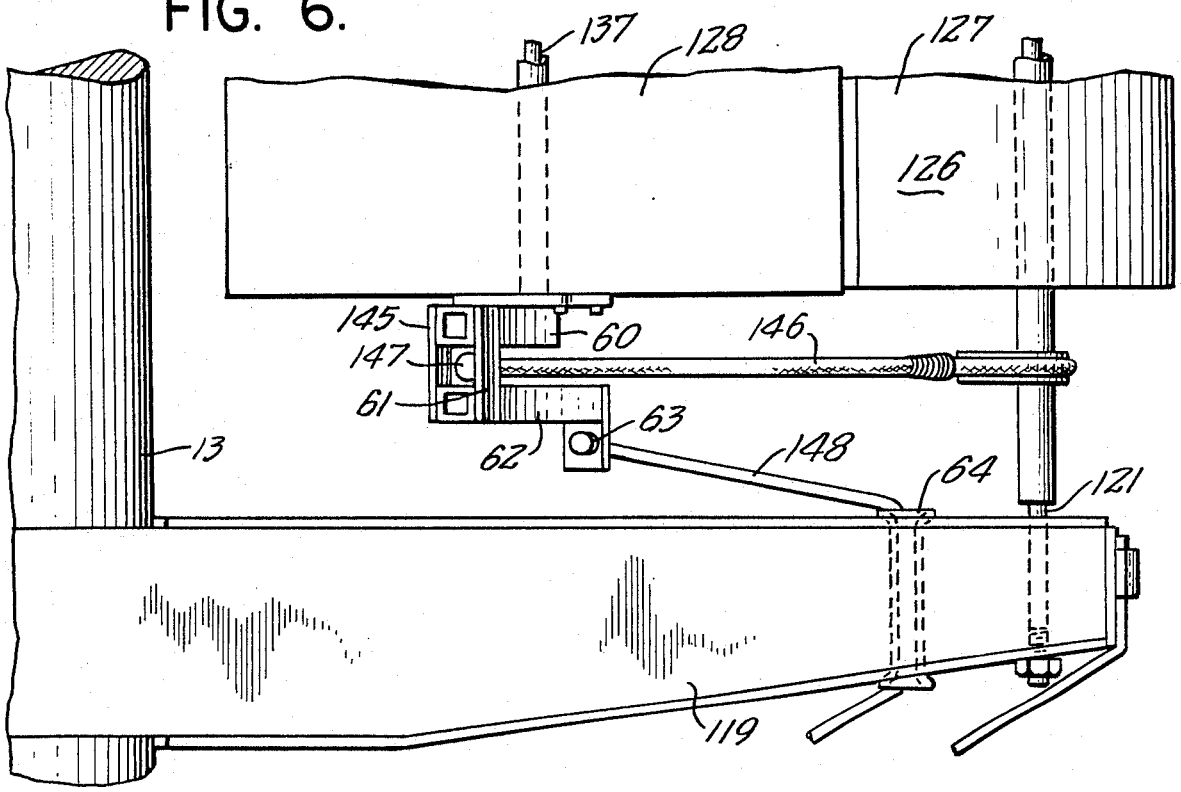
Figure 7:
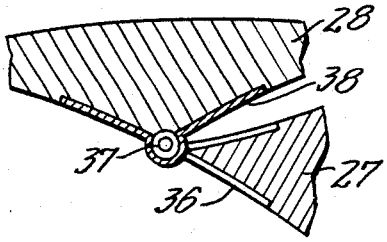
FIGS. 7–9 are fragmentary cross sectional views taken generally on lines 7—7, 8—8 and 9—9 respectively of FIG. 4 and showing structural details of the articulated foil structure.
Figure 8:
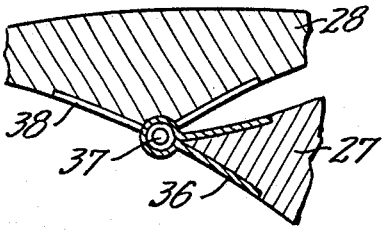
Figure 9:
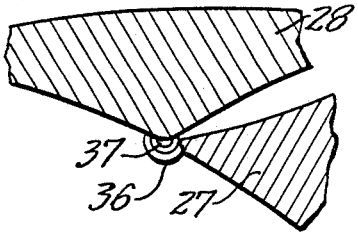

In the form of the invention shown in FIGS. 5 and 6, forward and aft foil-forming sections 127, 128 are of substantially the same construction and configuration as the sections 27, 28 of FIGS. 1–4. The function and operation of the respective parts is essentially the same, except that only a single tacking line 148 is utilized to reverse the working position of the flap-forming foil section 128, regardless of which side of the vessel center line the slot-forming foil is on after the tack.

As shown particularly in FIG. 6, a generally J-shaped bracket 145 is fixed to the bottom of the flap-forming foil section 128. The shorter, upper arm 60 of the J-shaped bracket is fixed directly to the foil section 128 and extends along the axis of symmetry of the flap-forming section to a point well aft of the convex back surface 139 of the flap-forming section. The base portion of the J-shaped arm is formed by a vertical bar 61, which is connected to a horizontal arm 62 extending along the axis of symmetry of the flap-forming section 128 to a point well beyond the forward extremity thereof. The respective arms 60, 61 thus provide pivoting leverage about the hinge axis 137 of the flap-forming foil.

Anchored to the vertical bar 61, at 147, is one end of an elastic member 146, which is attached at its forward end to a stainless steel cable 121 extending from the lower mast bracket 119 to an upper mast bracket (not shown) and serving as a pivot support for the entire slot-forming foil assembly 126.

A single tacking line 148 is secured at 63, to the forward or windwardmost extremity of the lower arm 62 of the J-shaped lever 145. The tacking line extends in a generally forwardly direction from the arm 62 and enters and passes through a fair lead tube 64 provided in the mast bracket 119. The line emerges from the lower end of the fair lead tube and from there extends to any convenient point on the vessel, where it may be manipulated by the crew.

As reflected in FIG. 5, the fair lead tube 64 is located on the center line 65 of the mast bracket 119. The fair lead tube is thus asymmetrically located with respect to the center line 140 of the forward foil section 127, whenever the foil assembly is positioned for one tack or the other. With reference to FIG. 5, if the vessel were to change tacks from the position shown, the asymmetrical foil assembly would swing through from a position on one side of the bracket center line 65, as shown, to a position on the opposite side of the center line 65. With the flap-forming section 128 still in the position shown in FIG. 5, but the assembly 126 as a whole having swung through the opposite side of the center line 65, the J-shaped lever 145 can be pulled to and beyond the dead center position by the application of tension to the single tacking line 148. Accordingly, as soon as the slot-forming foil assembly has tacked through to a new tack, with the flap-forming section 128 on the "wrong" side, the single tacking line 148 becomes operative and allows the flap to be reversed by pulling on the tacking line. When the foil assembly 126 is in the condition shown in FIG. 5, the flap section 128 normally cannot be reversed, inasmuch as the bracket 145 cannot be drawn past the dead center position.

In the version of the invention shown in FIGS. 10–13, the slot-forming foil assembly is fully self-tacking. Moreover, but independently, the invention is shown as in use on a vessel with a tripod rig instead of a conventional mast.

Figure 10:
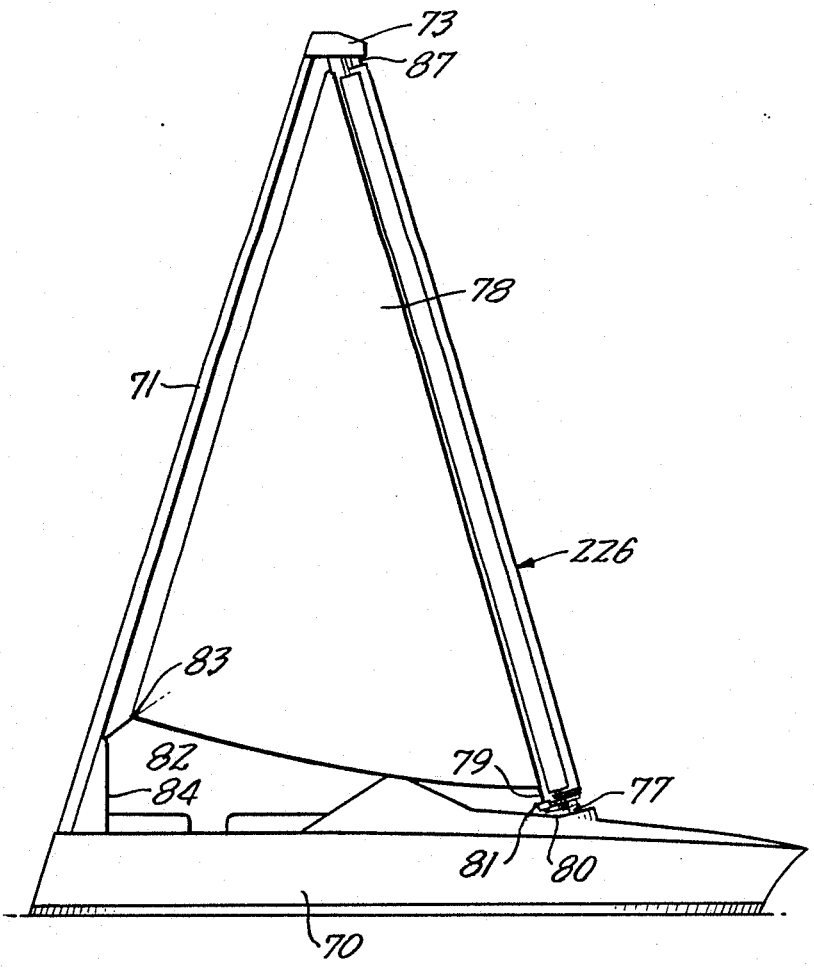
FIG. 10 is a side elevational view of a modified form of sailing yacht, utilizing a tripod rig, and incorporating the slot-forming foil structure of the invention.
Figure 11:
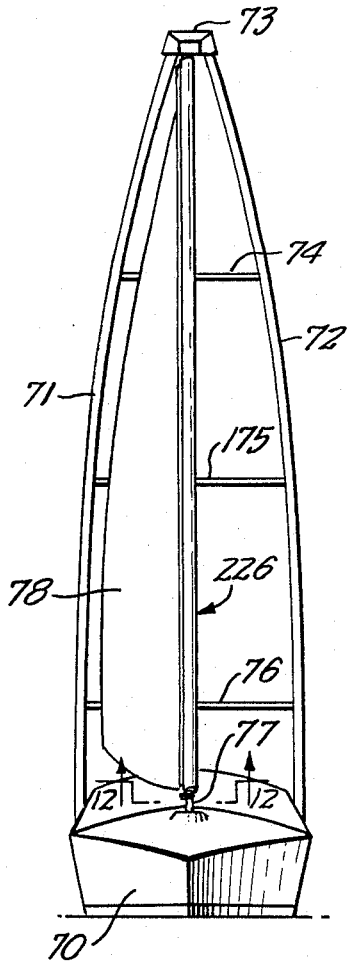
FIG. 11 is a front elevational view of the yacht of FIG. 10.

Referring to FIGS. 10 and 11, the reference numeral 70 designates the hull of a modified sailing vessel which is provided, in place of the usual stayed or unstayed mast, with a tripod rig comprising a pair of aft supports 71, 72 extending upward from opposite sides of the hull to the equivalent of a mast head fitting 73 at the top of the rig. A plurality of spreader elements 74, 76 extend laterally from between the supports 71, 72, at various heights, to maintain the elements slightly bowed in the lateral direction for increased stability. A third support element 77, located forward and amidships, extends downward from the mast head fitting 73 to the deck of the vessel. A principal working sail 78, equivalent to a main sail, is supported on a tensioned luff wire or foil 79 supported at its upper end by the mast head fitting 73 and at its lower end by a deck fitting 80. To advantage, the luff wire or foil may be rotatable by means of a drum 81 and furling line (not shown) to roll up the working sail 78 when desired. A sheet 82 extends from the clew 83 of the working sail into a bridge 84, provided with a traveler and/or other tackle for accommodating adjustment and trim of the working sail.

Mounted on the forward support 77 is a slot-forming foil assembly 226, comprising a forward foil section 227 and a flap-forming aft foil section 228. The general configuration and functioning of the flap sections 227, 228 are identical to the flap sections 27, 28 and 127, 128 heretofore described. However, in the mechanism illustrated in FIGS. 12 and 13, provisions are made for fully automatic self-tacking of the foil assembly when the vessel is steered from one tack to the other.

Figure 12:
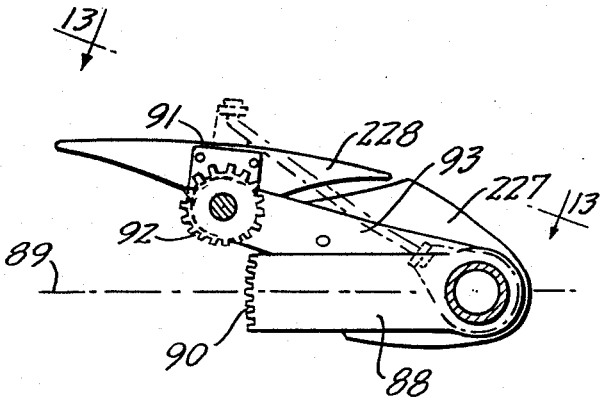
FIG. 12 is an enlarged, fragmentary cross sectional view as taken generally on line 12—12 of FIG. 11 and showing a mechanism for fully self-tending operation of the slot-forming foil.
Figure 13:
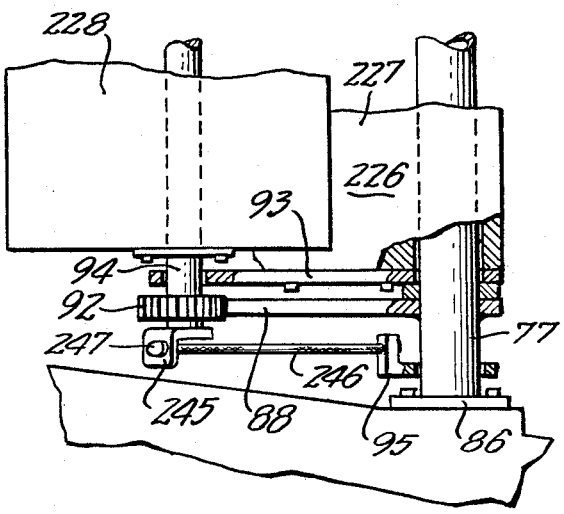
FIG. 13 is a fragmentary view, partly in section, as taken generally on line 13—13 of FIG. 12.

With particular reference to FIGS. 12 and 13, there is rigidly secured to the forward tripod support 77 and thus to the vessel itself, a metal bracket 88, which extends rearward along the center line 89 of the vessel and has formed at its aft end an arcuate rack 90 (see FIG. 12). Fixed to the lower portion of the flap-forming foil section 228 is a shaft 94 having a portion projecting in a downward direction, along the axis of rotation of the flap-forming section 228. A pinion 92 is fixed to the shaft 94 for rotation with the foil section 228. In the illustrated arrangement, a metal support bracket 93 is fixed to the bottom of the forward foil section 227 and extends to and rotatably supports the lower end of the shaft 94.

Secured to the lower end extremity of the shaft 94 is a lever arm 245 to which is anchored at 247 an elastic element 246. The elastic element extends forward from the lever arm 245 and is anchored by a bracket 95 mounted on the tripod support 77. The elastic element 46 is always under tension and serves to maintain the flap-forming section 228 in one or the other of its alternate working positions.

When the vessel is steered to a new tack, wind pressure on the convex side of the foil assembly causes the assembly to be pivoted from one side of the vessel center line to the other, to assume a new working position on the leeward side of the vessel center line. As the foil assembly approaches and passes the vessel center line, during the tack, the pinion 92 engages the rack section 90, which is fixed to the vessel. Continued movement of the foil assembly causes the pinion 92 to engage and be rotated by the fixed rack 90. As a result, relatively limited pivotal movement of the assembly about the axis of the tripod support 77 causes substantial rotation of the flap-forming section 228 relative to the forward section 227, sufficient to cause the elastic element 246 to pass through its dead center position and forcibly swing the flap-forming section 228 all the way through to its opposite working position.

The present invention provides a highly practical and useful arrangement for making use of a slot-forming foil on a cruising size sailboat, where the foil assembly may be left in place during dockage and mooring. Important advantages of the present invention are realized by virtue of a unique, two-part construction of the slot-forming foil, with a symmetrical forward foil section and a pivotally mounted, symmetrical aft foil section forming a flap-forming member. The configuration of the respective foil sections is such that, in alternate working positions of the flap-like foil section, the foil assembly as a whole has a smoothly convex airfoil-like contour on the leeward side, and a smoothly concave contour on the windward side. When the vessel is tacked, the foil assembly swings through to the opposite side and the flap-like section is pivoted to its alternate working position. In the alternate working position, the asymmetry of the foil cross section is reversed, providing a highly efficient slot-forming arrangement on either tack.

To particular advantage, the pivoted foil-forming assembly is provided with a toggle mechanism which maintains the flap-like section in one or the other of its alternate working positions. In its normal position, with the flap-like section in its proper position, the slot-forming foil assembly is effectively self-tending in terms of its angle of attack relative to the center line of the vessel. It is entirely possible and feasible, of course, to provide for adjustable sheeting of the foil section, in a manner similar to the sheeting of a conventional jib. However, experience has shown that, in normal operation, the foil assembly will assume its own most efficient angle of attack for the particular conditions encountered at the moment. Since the relative wind acting on the foil assembly may vary both in velocity and direction from moment to moment, it is preferred to permit the foil assembly of the invention to tend itself in terms of its angle of attack.

Tacking of the slot-forming foil assembly from one side to the other of the vessel center line is automatic when the vessel is steered through the wind to the opposite tack. In some versions of the invention, it is necessary to flip the flap-like section from one working position to the other, and for this purpose the mechanism may be provided with a tacking line arrangement comprising either one or two tacking lines, as desired. Complete self-tending capability is built into the mechanism shown in FIGS. 12 and 13, where upon swinging through of the foil assembly during tacking, the flap section 228 is flipped from one working position to the other, by a rack and pinion arrangement, which is momentarily engaged during the tacking procedure.

The asymmetrical slot-forming device of the invention is able to improve significantly the tacking angle of a jibless sailing vessel, enabling the vessel to realize significant improvement in its windward performance. In this respect, all sailing vessels, when attempting to sail in a direction from which the wind is blowing, must sail a zigzag course, first on one tack and then on the other. The more closely a vessel may sail to the direction of the true wind, the shorter distance it is required to travel to reach a windward destination. As is well known, jibless sailing vessels generally are characterized by rather poor windward performance, while having compensating desirable features, such as excellent off-wind performance, ease of handling, etc. With the mechanism of the invention, significant improvement can be realized in windward performance, with no sacrifice whatever to the other desirable features of the jibless rig.

A significant practical aspect of the invention is that the asymmetrical foil mechanism may be left unattended at a dock or mooring because of its rigid, asymmetrical construction. A symmetrical foil device, in contrast, will tend to self-destruct in high winds, because of aerodynamic instability.

It should be understood of course that the specific form of the invention herein illustrated and described is intended to be representative only, as certain variations may be made therein without departing from the clear teachings of the disclosure. Accordingly, reference should be made to the following appended claims in determining the full scope of the invention.

I claim:

1. A slot-forming foil structure for a sailing vessel having a working sail, which comprises (a) a forward foil section generally symmetrical cross-section, formed of relatively solid, rigid material, (b) means mounting said forward foil section in front of said working sail for pivoting movement about the axis of symmetry of said foil section and about an axis generally parallel to the luff of said working sail, (c) said forward foil section having a trailing edge located on the plane of symmetry thereof, (d) an aft foil section, formed of relatively solid, rigid material, pivotally mounted along the trailing edge of said forward foil section, (e) said aft foil section being pivotable between alternate working positions, and (f) said forward and aft foil sections forming a reversible asymmetrical foil structure of generally convex contours on one side and generally concave contours on the other side.

2. A slot-forming foil structure according to claim 1, further characterized by (a) toggle means operative, when said aft foil section is pivoted to either working position, to retain it in said working position.

3. A slot-forming foil structure according to claim 1, further characterized by (a) said foil structure being substantially free swinging on its support and thus adapted to assume a slot-forming position on either tack, and (b) means being provided for pivoting said aft foil section, relative to said forward foil section, from one working position to another when said foil section is positioned for a new tack of the sailing vessel.

4. A slot-forming foil structure according to claim 3, further characterized by (a) said means for pivoting said aft foil section comprising tacking line means connected to said aft foil section and operative when actuated to swing said aft foil section from one working position to the other.

5. A slot-forming foil structure for a sailing vessel having a working sail, which comprises (a) a forward foil section having a generally symmetrical cross section, (b) means mounting said forward foil section in front of said working sail for pivoting movement about an axis generally parallel to the luff of said working sail, (c) an aft foil section pivotally mounted along the trailing edge of said forward foil section, (d) said aft foil section being of generally symmetrical cross section and being pivotable between alternate working positions, (e) said forward and aft foil sections forming a reversible asymmetrical foil structure of generally convex principal contours on one side and generally concave principal contours on the other side.

6. A slot forming foil structure for a sailing vessel having a working sail, which comprises:

(a) a forward foil section of relatively solid, rigid material, (b) means mounting said forward foil section in front of said working sail for pivoting movement about an axis generally parallel to the luff of said working sail, (c) an aft foil section, formed of relatively solid, rigid material, pivotally mounted along the trailing edge of said forward foil section, (d) said aft foil section being pivotable between alternate working positions, (e) said forward and aft foil sections forming a reversible asymmetrical foil structure of generally convex contours on one side and generally concave contours on the other side, (f) toggle means operative, when said aft foil section is pivoted to either working position, to retain it in said working position, (g) said toggle means comprising an elastic member secured at opposite ends to said forward and aft foil sections and extendable under tension during pivoting of said aft foil section relative to said forward foil section from one working position toward asymmetrical mid position.

7. A slot forming foil structure for a sailing vessel having a working sail, which comprises:

(a) a forward foil section of relatively solid, rigid material, (b) means mounting said forward foil section in front of said working sail for pivoting movement about an axis generally parallel to the luff of said working sail, (c) an aft foil section, formed of relatively solid, rigid material, pivotally mounted along the trailing edge of said forward foil section, (d) said aft foil section being pivotable between alternate working positions, (e) said forward and aft foil sections forming a reversible asymmetrical foil structure of generally convex contours on one side and generally concave contours on the other side, (f) said forward foil section having a forward portion of symmetrically convex external contours and an aft portion of symmetrically concave contours terminating at a relatively sharp trailing edge, (g) said aft foil section being pivotally connected to said forward section substantially at said trailing edge, (h) said aft foil section being of generally symmetrical cross section having a convex rear surface and concave forward surface portions joined at the center line of said aft foil section and extending in opposite directions to the opposite ends of said convex rear surface, (i) the convex surfaces of said aft foil section forming, when said aft foil section is in one of its working positions, a smooth continuation of the convex contours of said forward foil section, and (j) the concave surfaces of said aft foil section forming, when said aft foil section is in one of its working positions, a smooth continuation of the concave contours of said forward foil section.

8. A slot forming foil structure for a sailing vessel having a working sail, which comprises:

(a) a forward foil section of relatively solid, rigid material, (b) means mounting said forward foil section in front of said working sail for pivoting movement about an axis generally parallel to the luff of said working sail, (c) an aft foil section, formed of relatively solid, rigid material, pivotally mounted along the trailing edge of said forward foil section, (d) said aft foil section being pivotable between alternate working positions, (e) said forward and aft foil sections forming a reversible asymmetrical foil structure of generally convex contours on one side and generally concave contours on the other side, (f) said foil structure being substantially free swinging on its support and thus adapted to assume a slot-forming position on either tack, (g) means being provided for pivoting said aft foil section, relative to said foward foil section, from one working position to another when said foil section is positioned for a new tack of the sailing vessel, (h) said means for pivoting said aft foil section comprising tacking line means connected to said aft foil section and operative when actuated to swing said aft foil section from one working position to the other, and (i) said tacking line means comprising a pair of tacking lines connected to opposite sides of said aft foil section and adapted for selective tensioning to move said aft foil section from one working position to another.

9. A slot-forming foil structure according to claim 8, further characterized by (a) said tacking lines being lead forward from said aft foil section, and (b) guide means for said tacking lines being mounted on said forward foil section.

10. A slot forming foil structure for a sailing vessel having a working sail, which comprises:

(a) a forward foil section of relatively solid, rigid material, (b) means mounting said forward foil section in front of said working sail for pivoting movement about an axis generally parallel to the luff of said working sail, (c) an aft foil section, formed of relatively solid, rigid material, pivotally mounted along the trailing edge of said forward foil section, (d) said aft foil section being pivotable between alternate working positions, (e) said forward and aft foil sections forming a reversible asymmetrical foil structure of generally convex contours on one side and generally concave contours on the other side, (f) said foil structure being substantially free swinging on it support and thus adapted to assume a slot-forming position on either tack, (g) means being provided for pivoting said aft foil section, relative to said forward foil section, from one working position to another when said foil section is positioned for a new tack of the sailing vessel, and (h) toggle means interconnecting said forward and aft foil sections for retaining said aft foil section in one working position or the other independently of said means for pivoting.

11. A slot forming foil structure for a sailing vessel having a working sail, which comprises:

(a) a forward foil section of relatively solid, rigid material, (b) means mounting said forward foil section in front of said working sail for pivoting movement about an axis generally parallel to the luff of said working sail, (c) an aft foil section, formed of relatively solid, rigid material, pivotally mounted along the trailing edge of said forward foil section, (d) said aft foil section being pivotable between alternate working positions, (e) said forward and aft foil sections forming a reversible asymmetrical foil structure of generally convex contours on one side and generally concave contours on the other side, (f) said foil structure being substantially free swinging on its support and thus adapted to assume a slot-forming position on either tack, (g) means being provided for pivoting said aft foil section, relative to said forward foil section, from one working position to another when said foil section is positioned for a new tack of the sailing vessel, (h) said means for pivoting said aft foil section comprising rack-like means mounted in fixed relation to the sailing vessel substantially along its centerline, and (i) pinion-like means mounted on said aft foil section and engageable with said rack-like means during pivoting of said forward foil section from one tack to the other.

* * * * *